US011402151B2

(12) United States Patent
Degenstein et al.

(10) Patent No.: US 11,402,151 B2
(45) Date of Patent: Aug. 2, 2022

(54) LIQUID NATURAL GAS LIQUEFIER UTILIZING MECHANICAL AND LIQUID NITROGEN REFRIGERATION

(71) Applicants: Nick J Degenstein, East Amherst, NY (US); James R Handley, East Amherst, NY (US); Mohammad Abdul-Aziz Rashad, Clarence, NY (US)

(72) Inventors: Nick J Degenstein, East Amherst, NY (US); James R Handley, East Amherst, NY (US); Mohammad Abdul-Aziz Rashad, Clarence, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 581 days.

(21) Appl. No.: 15/903,172

(22) Filed: Feb. 23, 2018

(65) Prior Publication Data

US 2018/0292128 A1 Oct. 11, 2018

Related U.S. Application Data

(60) Provisional application No. 62/463,269, filed on Feb. 24, 2017.

(51) Int. Cl.

| | |
|---|---|
| ***F25J 1/02*** | (2006.01) |
| ***F25J 1/00*** | (2006.01) |
| ***F25J 5/00*** | (2006.01) |

(52) U.S. Cl.

CPC ..... *F25J 1/0012* (2013.01); *F25J 1/004* (2013.01); *F25J 1/005* (2013.01); *F25J 1/0022* (2013.01); *F25J 1/0072* (2013.01); *F25J 1/0204* (2013.01); *F25J 1/0205* (2013.01); *F25J 1/0221* (2013.01); *F25J 1/0258* (2013.01); *F25J 1/0263* (2013.01); *F25J 1/0265* (2013.01); *F25J 1/0267* (2013.01); *F25J 1/0274* (2013.01); *F25J 1/0281* (2013.01); *F25J 5/002* (2013.01); *F25J 2200/74* (2013.01); *F25J 2205/40* (2013.01);

(Continued)

(58) Field of Classification Search

CPC ..... F25J 1/005; F25J 1/0012; F25J 1/0072; F25J 1/0281; F25J 1/0092; F25J 1/0204; F25J 1/0221; F25J 2215/04; F25J 2240/44; F25J 2220/64; F25J 2270/14

See application file for complete search history.

(56) References Cited

U.S. PATENT DOCUMENTS

| | | | |
|---|---|---|---|
| 3,362,173 | A | 1/1968 | Ludwig |
| 3,677,019 | A | 7/1972 | Olszewski |

(Continued)

FOREIGN PATENT DOCUMENTS

| | | | |
|---|---|---|---|
| WO | 2010128467 | A2 | 11/2010 |

OTHER PUBLICATIONS

Wilfried Bach et al.; Offshore Erdgasverflussigung Mit Stickstoffkalte—Prozebauslegung Und Vergleich Von Gewickelten Rohr-Und Plattenwarmetauschern; Berichte Aus Technik Und Wissenschaft, Linde AG, Wiesbaden, DE, No. 64, Jan. 1, 1990 (Jan. 1, 1990), pp. 31-37, XP000114322; ISSN: 0942-332X.

(Continued)

*Primary Examiner* — Brian M King

(74) *Attorney, Agent, or Firm* — Iurie A. Schwartz

(57) ABSTRACT

The present invention relates to a method and system for producing liquefied natural gas (LNG) from a stream of pressurized natural gas which involves a combination of mechanical refrigeration.

8 Claims, 4 Drawing Sheets

(52) U.S. Cl.
CPC ..... *F25J 2205/66* (2013.01); *F25J 2210/42* (2013.01); *F25J 2210/62* (2013.01); *F25J 2220/64* (2013.01); *F25J 2235/42* (2013.01); *F25J 2240/40* (2013.01); *F25J 2240/44* (2013.01); *F25J 2270/14* (2013.01)

(56) References Cited

U.S. PATENT DOCUMENTS

| | | | | |
|---|---|---|---|---|
| 4,033,735 | A | 7/1977 | Swenson | |
| 5,755,114 | A | 5/1998 | Foglietta | |
| 6,094,937 | A * | 8/2000 | Paurola | F25J 1/0022 62/613 |
| 6,412,302 | B1 | 7/2002 | Foglietta | |
| 2010/0186445 | A1* | 7/2010 | Minta | F25J 1/0022 62/606 |
| 2012/0060553 | A1* | 3/2012 | Bauer | F25J 1/0022 62/614 |
| 2016/0003527 | A1* | 1/2016 | Dean | F25J 1/005 62/614 |

OTHER PUBLICATIONS

Tianbiao HE et al.; A Novel Conceptual Design Of Parallel Nitrogen Expansion Liquefaction Process For Small-Scale LNG (liquefied natural gas) plant in skid-mount packages; Energy, Elsevier, Amsterdam, NL, vol. 75, Aug. 19, 2014 (Aug. 19, 2014) pp. 349-359, XP029061068, ISSN: 0360-5442, DOI: 10.1016/J.ENERGY, 2014. 07.084.

* cited by examiner

LIQUID NATURAL GAS LIQUEFIER UTILIZING MECHANICAL AND LIQUID NITROGEN REFRIGERATION

CROSS REFERENCE TO RELATED APPLICATION(S)

This application claims the benefit of provisional application Ser. No 62/463,269 filed Feb. 24, 2017, entitled LIQUID NATURAL GAS LIQUEFIER UTILIZING MECHANICAL AND LIQUID NITROGEN REFRIGERATION.

FIELD OF THE INVENTION

The present invention relates to a method and system for producing liquefied natural gas (LNG) from a stream of pressurized natural gas which involves a combination of mechanical refrigeration produced by the reverse Brayton cycle as well as refrigeration from evaporation of liquid nitrogen.

BACKGROUND OF THE INVENTION

Traditional LNG liquefiers do not scale down well in terms of capital cost and liquefaction power per unit of LNG produced. On the smallest end of mechanical refrigeration based LNG liquefiers (e.g. up to 100,000 gallons per day (GPD)) common liquefaction approaches include: single mixed gas refrigerant cycles (MGR) as disclosed in Swenson (U.S. Pat. No. 4,033,735) as well as single or double turbine reverse Brayton cycles where the working fluid(s) is typically nitrogen and/or a methane rich fluid derived from the feed natural gas as disclosed, for example in Olszewski (U.S. Pat. No. 3,677,019) and Foglietta (U.S. Pat. No. 6,412,302). Other concepts may include a pre-cooling step in combination with the approaches described above, or multiple pure/mixture refrigerants in a cascade refrigerant system arrangement. See Ludwig and Foglietta (U.S. Pat. Nos. 3,362,173, and 5,755,114, respectively).

In the small LNG liquefiers the relatively high liquefaction power per unit LNG produced is due to a variety of factors such as: 1) high efficiency equipment options and/or process cycles cannon be justified due to high capital expense, 2) equipment and/or high efficiency performance that is available on the large scale does not scale down well to a much smaller size (compressors, turbines, heat exchangers, etc.). Also key pieces of installed equipment do not scale down well in terms of capital such as compressors, heat exchangers, water/$CO_2$/heavy hydrocarbon removal, LNG storage, etc.

The power efficiency of these small mechanically-refrigerated liquefiers depends on liquefaction cycle, natural gas (NG) feed pressure and is also heavily dependent on plant size through breakpoints and tradeoffs in terms of equipment efficiency (especially such as compressor and turbine efficiency). For example, for a fixed NG feed pressure and fixed liquefaction process (single nitrogen expander process), liquefaction power can vary from 1.0 kwh/kg LNG (~31,000 GPD LNG) to 0.80 kwh/kg LNG (54,000 GPD LNG) to 0.6 kwh/kg LNG (124,000 GPD LNG).

The reasons for this dramatic increase in unit power as LNG capacity is decreased has to do with compressor efficiency and gear losses in the smallest units as well as lower turbine efficiency in the smaller units (as these small turbines are at the limit of what is possible to achieve with high efficiency radial inflow turbines in terms of size/efficiency).

In this smallest scale of LNG liquefiers nitrogen is utilized as the recirculating refrigerant over a methane or natural gas-based fluid due to turbo machinery considerations associated with high efficiency radial inflow turbines (although methane expansion thermodynamically leads to a more efficient liquefier at an equivalent turbine efficiency). Modern radial inflow turbines have a significant efficiency advantage over other types of small turbines which makes it advantageous to use this type of turbine even in small scale LNG liquefiers. At a small scale of high efficiency radial inflow turbines (e.g., 80% to 90% isentropic efficiencies) a methane rich fluid being much lower in molecular weight versus nitrogen causes a methane radial inflow turbine to be a much higher turbine shaft speed which would typically push a methane turbine past a shaft speed break point in equipment capability and cost (not to mention simplicity/safety considerations associated with $N_2$ vs. methane). As liquefiers get larger (e.g. >200,000 GPD) the higher refrigerant mass flow renders methane turbines lower in speed which enables the use of high efficiency radial inflow turbines and efficiency gains associated with methane expansion versus $N_2$ expansion can be realized.

By comparison medium size LNG cycles based on simple single MGR or dual $N_2$ expansion processes achieve a power efficiency of around between 0.35 to 0.45 kwh/kg LNG. However, these types of plants are typically practiced on the scale of 0.1 to >0.5 million tonnes per annum (MTPA) which is equivalent to 175,000 to >850,000 GPD of LNG.

The combination of relatively low power efficiency (versus larger LNG liquefiers) and high capital cost per LNG capacity mean that in this class of small mechanically-refrigerated LNG liquefiers the available technology solutions are not that compelling from a capital or operational expenditure standpoint. This applies to LNG plant sizes that are less than about 100,000 GPD and especially to LNG plant sizes that are less than 50,000 GPD.

Another complicating factor is that prospective small LNG plant operators/distributors typically need to secure many customers to justify even the smallest LNG plants as they might not be base-loaded by a single large customer. LNG supply to applications involving vehicles, heavy duty trucks, locomotives, mining trucks, etc., typically involves risk and some significant planning and cost associated with engine conversion, LNG storage, etc. In order to justify investment and risk by the final LNG consumer a sufficient spread in energy price between LNG and the incumbent fuel (e.g., diesel, gasoline, etc.) is needed (outside of regulatory or policy mandates).

From the perspective of the small LNG plant operator/distributor it is typically not possible to secure all the LNG customers needed to fully load the LNG plant in advance of LNG plant planning and construction. This leaves the prospective LNG plant operator to secure some initial LNG customers and to oversize the LNG plant to allow for future customers and ultimately a good project return. As the local LNG market matures the LNG operator can ramp up LNG production with the hope of being able to eventually earn a sufficient project return. Because of these considerations prospective small LNG plant owners/operators are especially sensitive to high capital cost.

One potential known solution to the high capital cost of small mechanically refrigerated LNG liquefiers is to instead use an LNG liquefier that consumes liquid nitrogen (LIN). Liquid nitrogen is supplied and vaporized within the LIN-to-LNG liquefier in order to supply the refrigeration needed to liquefy feed natural gas. In this approach the mechanical refrigeration (and required capex) associated with generating LIN is essentially outsourced to the LIN supplier. In this case because the LIN to LNG liquefier contains no mechanical refrigeration equipment (large/expensive compressors, turbines, etc.) and because the LIN to LNG process requires fewer and simpler heat exchangers the LIN-to-LNG process is requires much less capital expanditure and very little site power. Further, this type of liquefier being simple and compact with no or minimal rotating equipment can be designed to be easily re-locatable. As a consequence of vaporizing LIN significant quantities of warmed gaseous nitrogen (GAN) is produced. A portion of this warmed gaseous nitrogen can be used to regenerate adsorbent beds that are used to remove water and $CO_2$ (and possibly some or all of the heavy hydrocarbons) from the natural gas feed. An adsorbent based pre-purification process using clean GAN for regeneration saves additional capital and complexity in this type of small LIN-to-LNG liquefier.

While this type of liquefier does have capital and simplicity advantages over direct mechanically-refrigerated LNG liquefiers drawbacks of the LIN to LNG process include cost and availability of LIN. LIN consumption is directly tied to LNG production and this simple type of LNG liquefier can be efficiently operated at reduced LNG production. Maximum available LIN volume can serve as a size limitation for the LIN to LNG liquefier as approximately 10 pounds of LIN are required to liquefy each gallon of LNG (depending on NG composition and feed pressure). Typically LIN would be sourced from an industrial gas supplier.

LIN to LNG liquefiers are well known in the prior art and are typically used for LNG liquefiers in the <5,000 to 10,000 GPD of LNG liquefier size range with max size depending on LIN availability and size at which high LIN operational expenditure is too much versus a capex intensive and reduced opex small mechanically-refrigerated LNG liquefier.

A niche exists at a production scale between about 10,000 GPD and 100,000 GPD LNG where LIN-to-LNG processes (high operating expenses, LIN availability, low capital expenditures) have general limited application and where application of small mechanically-refrigerated LNG liquefiers (moderate opex, high capex) is also limited.

Thus, to overcome the disadvantages of the related art, one of the objectives of the present invention is to provide a small LNG liquefiers at a nominal 50,000 GPD LNG size range which require reduced capital and similar operating expenditures versus small mechanically refrigerated LNG liquefiers, as well as reduced operational expenditures versus LIN to LNG liquefiers.

It is another object of the invention to provide a 'hybrid' LNG liquefier which uses a mechanical refrigeration system to generate warm end refrigeration needed to partially cool natural gas as well as vaporizing LIN supply to supply the balance of cold-end-refrigeration needed to fully cool and liquefy the feed natural gas stream. The warm end mechanical refrigeration system utilize the reverse Brayton cycle where the working fluid in the reverse Brayton cycle can be natural gas feed (or derived from the natural gas feed stream), pure nitrogen, oxygen depleted air, argon, or any other appropriate dry and safe working fluid or combination thereof.

Other objects and aspects of the present invention will become apparent to one skilled in the art upon review of the specification, drawings and claims appended hereto.

SUMMARY OF THE INVENTION

In a preferred exemplary embodiment of the invention, vaporized and warmed liquid nitrogen is employed to regenerate an adsorption based pre-purification system (water and carbon dioxide removal) such that a more complex and capital intensive amine and dryer system (using recirculated/purified natural gas as regeneration gas can be avoided). In addition, in this exemplary embodiment nitrogen is utilized as the working fluid in the reverse Brayton cycle which provides warm end refrigeration and the makeup for the reverse-Brayton recirculating $N_2$ loop will be provided by boiled/warmed LIN/GAN. Further, $N_2$ compressor discharge can be used as a pressure building GAN source for the LIN tanks (saving 1.5 to >4% of total LIN use depending on desired LIN boiling pressure).

Because this Hybrid mechanical+LIN process arrangement requires reduced amount of refrigeration generated from the reverse-Brayton expansion cycle versus other small $N_2$ based expansion cycles where all of the process refrigeration comes from $N_2$ expansion there is significant flexibility in selecting recirculating refrigerant (typically $N_2$) compressor feed and discharge pressure (turbine expansion pressure ratio) and recirculating refrigerant flow. In particular, this provides flexibility from an expansion turbine design perspective such that a very high efficiency radial inflow turbine (e.g., 85 to 90% efficiency at a relatively low shaft speed) can be designed even for a very small liquefier (e.g., 25,000 GPD LNG). The possibility for lower turbine shaft speed is achievable in part because the recirculating fluid (typically higher MW $N_2$ vs. methane) can be designed for lower isentropic head (lower expansion pressure ratio) and lower inlet pressure (higher acfm flow) which allows for slow down the turbine shaft speed.

Other significant advantages afforded by this hybrid liquefier approach is that the concept can be extended into an upgradeable LNG liquefier in that the first phase would be sacrificial LIN only (e.g., at the 10,000 GPD LNG scale) and the second phase could be a hybrid $N_2$ expander+sacrificial LIN to LNG liquefier to substantially reduce specific LIN use (e.g., 30,000 GPD LNG production scale) and a third phase to add a second $N_2$ expansion turbine (or to upgrade the first turbine with higher flow/pressure ratio) to further reduce LIN operating cost and to further increase capacity and/or decrease LIN operational expenditures. The intent of the last phase of capital investment would be to end up with an LNG liquefier that is competitive on the operational expenditures with other small expansion based or single MGR based LNG liquefiers. In this way capital investment can be staged and the LNG liquefier production can be expanded as the LNG market matures or as demand grows. Furthermore, this approach of staged capital investment obviously reduces initial capital investment and risk to the prospective small LNG plant purchaser/operator.

Concurrent with the example 3 capital investment phases described above the natural gas pre-treatment system would likely need to be expanded and/or upgraded to account for increased NG flow as well as reduced available flow of clean, dry nitrogen gas for dryer and/or $CO_2$ removal regeneration. Additionally site storage capacity would likely also need to be upgraded in the example as LNG production grows from 10,000 GPD to >30,000 GPD.

Another significant advantage afforded by this hybrid liquefier approach is that the reduced power needed by the mechanical refrigeration system will more easily allow for the LNG liquefier to be located near to a high pressure natural gas source such as high pressure transmission pipelines and/or near to the final LNG customers. High pressure natural gas increases the capital and operational expenditure efficiency of the liquefaction equipment and process (smaller piping, no need for NG feed compressor) and further limits on transmission pipeline natural gas quality (water, $CO_2$, $H_2S$, $N_2$, natural gas liquids (NGL), etc.) can serve to reduce the range of natural gas quality that needs to be considered in a standardized LNG liquefier design. It is understood that LIN supply must be economically available at the prospective LNG plant site however in many industrially developed countries LIN supply is widely available through multiple industrial gas suppliers.

Traditional LNG liquefiers that are fully refrigerated by mechanical refrigeration (single or dual expansion and/or single MGR liquefiers) consume significant amounts of electricity for example with a 'traditional' 30,000 GPD LNG liquefier the power demand could be roughly 2 MW (3.5 lb. gallon LNG, $1.0 kwh/kg LNG) whereas the hybrid expansion+LIN liquefier of the present invention could consume only about 500 kw. A power demand on the order of 500 kw vs. 2 MW is much easier to source from the grid and/or is much easier to source using a natural gas engine driver (to drive the compressor) or a natural gas fueled genset. The preferred approach on this small hybrid liquefier scale would typically be to generate much or all of the liquefier power using the cheap pipeline natural gas via a NG engine driver on the compressor or by using a packaged NG genset. In this way the LNG production can be independent from the grid and power can be generated from relatively cheap and clean pipeline natural gas versus purchasing a relatively small amount of power of 500 kw to 2 MW (likely at a relatively expensive price) from a power utility. Additionally, if power is not purchased from the grid, time of day power pricing and other power utility related costs and complexity can be avoided (routing power to a potentially remote site, etc.).

Another significant advantage afforded by this hybrid liquefier approach is that the liquefier can be designed to be operated in an increased LIN use mode or a LIN only mode whereby all or some level of LNG production can be maintained even in the case of hot day conditions or rotating equipment outage, service or repair. Certain types of LNG liquefiers (e.g., typically refrigerant based cycles with or without pre-coolers such as single MGR cycles) are well known have significantly reduced capacity on hot day temperature conditions (or alternatively sizing equipment for hot day temperatures results in a large capital penalty versus what is required for average day). The hybrid liquefier can be designed to allow for operation in an increased LIN use mode where hot or warm day production shortfalls can be compensated for by using additional LIN (resulting in a short term opex penalty). Furthermore, a good spot market for small LNG liquefiers is to supply LNG to peak shavers and/or energy utilities on hot days (or cold days) when transmission and distribution pipeline capacity is stressed. The ability to boost production on hot days (or on cold days) is an advantageous feature not easily justified in traditional mechanically refrigerated liquefiers as it would typically incur a capital expenditure penalty for a low frequency/probability operation mode.

BRIEF DESCRIPTION OF THE DRAWINGS

The above and other aspects, features, and advantages of the present invention will be better understood when taken in connection with the accompanying Figures in which:

FIG. 2 is a schematic representation of various heat exchanger configurations that apply to the hybrid liquefier embodiments, wherein:

FIG. 2(*a*) is the heat exchanger (HX) configuration as shown in FIG. 1;

FIG. 2(*b*) depicts dual pressure LIN boiling;

FIG. 2(*c*) illustrates the cold end of the PHX;

FIG. 2(*d*) depicts the pump utilized to increase the pressure of the LIN boiled in the HX;

FIG. 2(*e*) illustrates a related pumped LIN process where LIN is boiled (or pseudo-boiled) and warmed;

FIG. 2(*f*) illustrates an embodiment where ow pressure LIN is boiled in the cold end of the heat exchanger;

FIG. 2(*g*) illustrates an embodiment where a portion of the NG feed is being split from the main cooled natural gas stream in the middle of the PHX;

FIG. 2(*h*) depicts an embodiment where the PHX heat exchanger configuration where the multi-stream heat exchanger is generally oriented horizontally.

FIG. 3*a* is a schematic representation of a small LNG liquefier depicting three separate liquefier deployment phases, wherein:

FIG. 3(*c*): illustrates Phase 2: addition of reverse Brayton refrigeration equipment to the Phase 1 equipment to boost LNG production and reduce specific LIN use;

FIG. 3(*d*) illustrates Phase 3: upgrade Brayton refrigeration equipment and pre-purifier to further boost capacity and/or reduce LIN use to make final liquefier competitive with pure mechanically refrigerated LNG liquefiers.

FIGS. 4(*a*) depicts portion of boiled GAN being redistributed to turbine air layers on the warm end of the PHX;

FIG. 4(*b*) depicts LIN being boiled and warmed to fully take advantage of the entire turbine pass;

FIG. 4(*c*) illustrates an embodiment where LIN is being boiled in the turbine air passes on the cold end of the heat exchanger; and FIG. 4(*d*) illustrates two separate phases as shown in FIGS. 4(*a*) and (*c*), respectively.

DETAILED DESCRIPTION

Figure 1:
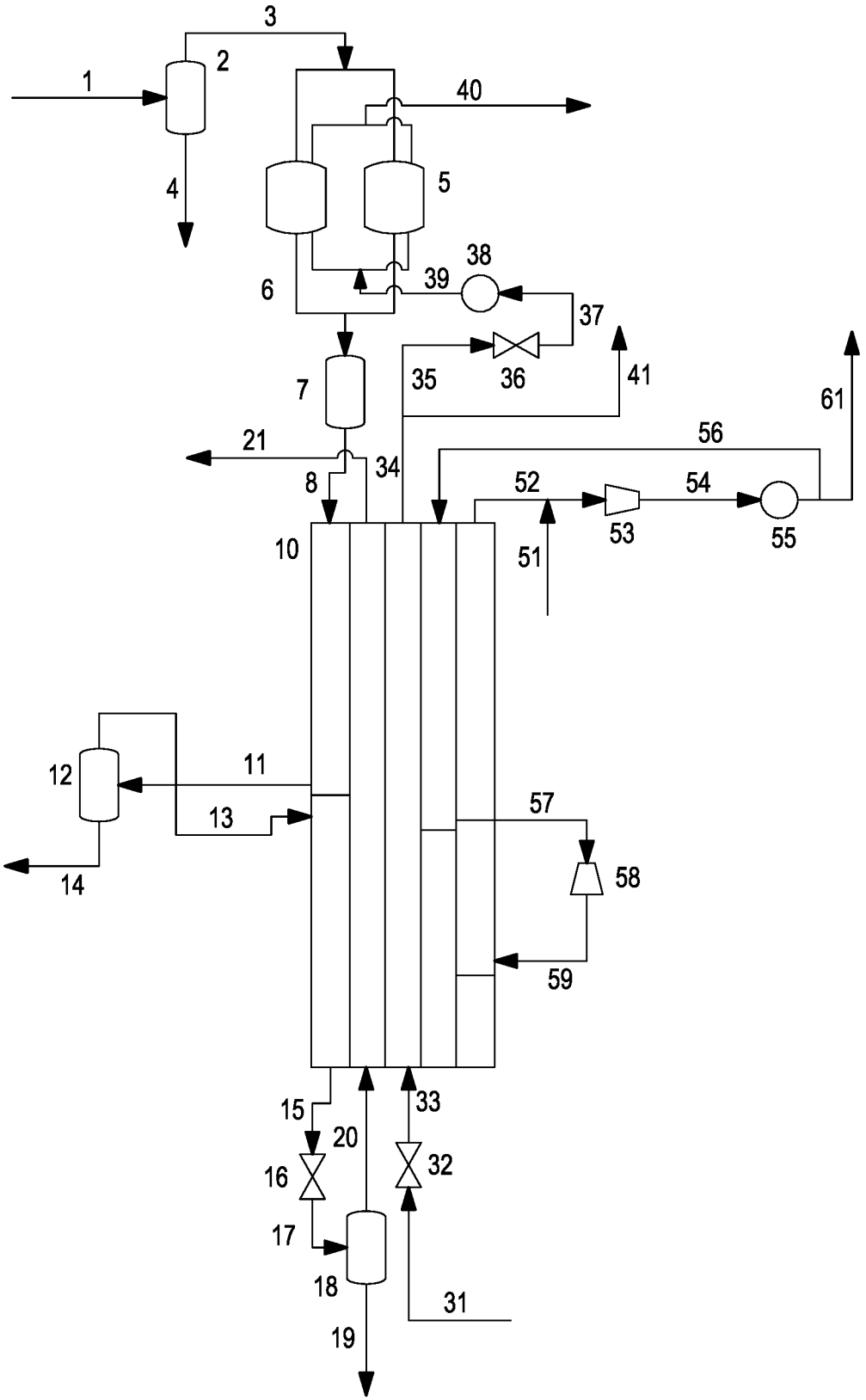
FIG. 1 is a schematic representation of a small LNG liquefier using a reverse Brayton expansion turbine for warm refrigeration and LIN vaporization for cold end refrigeration.

With reference to FIG. 1, a pressurized natural gas feed 1, is routed to the hybrid liquefaction process. Natural gas feed could be supplied from a pressurized source and/or compressed before being fed to this process. Natural gas could be sub or supercritical. Natural gas feed 1, is supplied to operation unit 2 such as a liquid separator, and vapor is fed to a step or series of steps for water, acid gas, $CO_2$ removal. In this exemplary embodiment, unit operation 5 is shown as a regenerable adsorption based unit for water and $CO_2$ removal from the feed natural gas stream. $CO_2$ is typically removed to a level of 50 ppm or less in the case of low pressure LNG product, and routed to operation unit 7. Thus unit 7 is a non-regenerable adsorption based unit, for example for removal of mercury and/or other species that could interfere with the downstream liquefaction process. It is understood that there are many configurations of natural gas pre-purification that can result in a stream suitable for natural gas liquefaction in terms of feed levels of moisture, $CO_2$, heavy hydrocarbons, NGL's, sulfur species, mercaptans, mercury, etc. These approaches include but are not limited to adsorption, absorption (pressure or temperature swing), amine systems, and membranes.

Clean pressurized natural gas stream 8 enters the primary LNG heat exchanger (PHX) 10, where it is cooled and liquefied. Heat exchanger 10 can be a single multi-stream heat exchanger, but the heat exchanger could be split up into multiple heat exchangers for example to accommodate heat exchanger limitation (maximum temperature differentials, block size, etc.). Natural gas feed is cooled to an intermediate temperature and taken as stream 11, where if necessary NGL's can be rejected. In this embodiment, NGL rejection is shown taking place in a single separator 12, but it is understood that the NGL and/or ethane rejection can be achieved using one or more separators, reboiled or refluxed columns, etc., in order to achieve final LNG product specifications or to ensure certain natural gas components do not freeze in the heat exchanger. Furthermore, it is understood that stream 14 can be further warmed in the PHX to recover refrigeration from this stream. Stream 13 is further cooled in the PHX to form a cooled and pressurized LNG stream (which may or may not be supercritical). The LNG stream is flashed across a valve 16 or expanded in a dense phase expander to a lower pressure which would typically be a pressure suitable for LNG storage. Depending on stream 15 temperatures and natural gas composition flashing the LNG across valve 16 which is routed to separator 18, where vapor stream 20 is taken and warmed in the PHX, while LNG product stream 19 is directed to storage. Separator 18 could also be exchanged for a reboiled and/or refluxed column for removal of $N_2$ and/or ethane from LNG. Stream 20 which is typically enriched in nitrogen, is warmed and then flared or used as regeneration energy or used in a natural gas driver or natural gas engine to supply all or part of the site liquefier power 21. Warmed stream 21 can also be sent to a recirculating methane rich circuit that generates warm end liquefier refrigeration through the reverse Brayton process.

Refrigeration in this cycle is supplied by liquid nitrogen (LIN) stream 31, which is supplied from storage. The LIN is supplied to the PHX and boiled and/or warmed in PHX 10. LIN could be boiled and/or warmed in the PHX in a sub or supercritical state. Typically, LIN is boiled above a certain pressure (3.5 bara) to avoid the possibility of freezing LNG on the cold end of the PHX. Advantages of boiling LIN at a high pressure (possibly requiring a LIN pump between the storage tank and PHX) allow for a reduction in the stream-to-stream maximum temperature delta on the cold end of the PHX. Limiting the maximum temperature delta in the cold end of the HPX can allow for a single brazed aluminum heat exchanger to be used for the entire PHX. Otherwise PHX 10 could need to be split between 2 heat exchangers, typically a brazed aluminum HX on the warm end and another HX that can mechanically tolerate large temperature differentials on the cold end. Also it is understood that LIN can be boiled at multiple pressures.

Boiled LIN emerges from the warm end of the PHX as gaseous nitrogen (GAN) stream 34. This GAN can be used for adsorbent bed regeneration stream 35, and/or for other purposes (stream 41) such as cold-box purging, instrument air, LIN tank pressure building, and makeup for nitrogen circuit compressor and turbine seal leakage.

The warm end refrigeration needed to liquefy the natural gas feed is generated through the reverse Brayton process where the working fluid is typically nitrogen but could also be derived from the natural gas feed (such as supplied by flash gas stream 21) or other fluids which can also be employed. Since the preferred recirculating fluid is nitrogen for small LNG liquefiers the remaining embodiments are described with the use of nitrogen in the recirculating circuit.

Pressurized nitrogen stream 56 is fed to the PHX and cooled and withdrawn from the PHX as stream 57. This stream is work expanded to a lower pressure in a turbine 58 to produce a low pressure $N_2$ stream 59. The turbine work can be dissipated in an oil brake system, used to drive a compressor such as one stage of $N_2$ compression, or used to drive a generator. This turbine is preferably a radial inflow turbine since high isentropic efficiencies are achievable with this type of turbine, but many other types of turbines or expanders could be used (e.g., scroll expanders).

The cold low pressure nitrogen stream 59 is then warmed and removed from the PHX as stream 52. Stream 52 is typically combined with makeup nitrogen 51 that is needed to replenish compressor and turbine and piping seal losses. The combined stream is subsequently compressed in one or more stages of compression, 53. This compressor could be composed of multiple stages or compressors with each stage or compressor possibly being of a different type (centrifugal, dry or oil-flooded screw, reciprocating, axial, etc.) with intercooling and/or aftercooling within or between compression stages. The pressure ratio across compressor 53 is typically between 3 and 8. The final compressed $N_2$ can be aftercooled and optionally split where a major portion of $N_2$ returns to the PHX as stream 56 and a minor portion 61 is employed for LIN tank pressure building, instrument air, adsorbent bed repressurization, etc.

Figure 2:
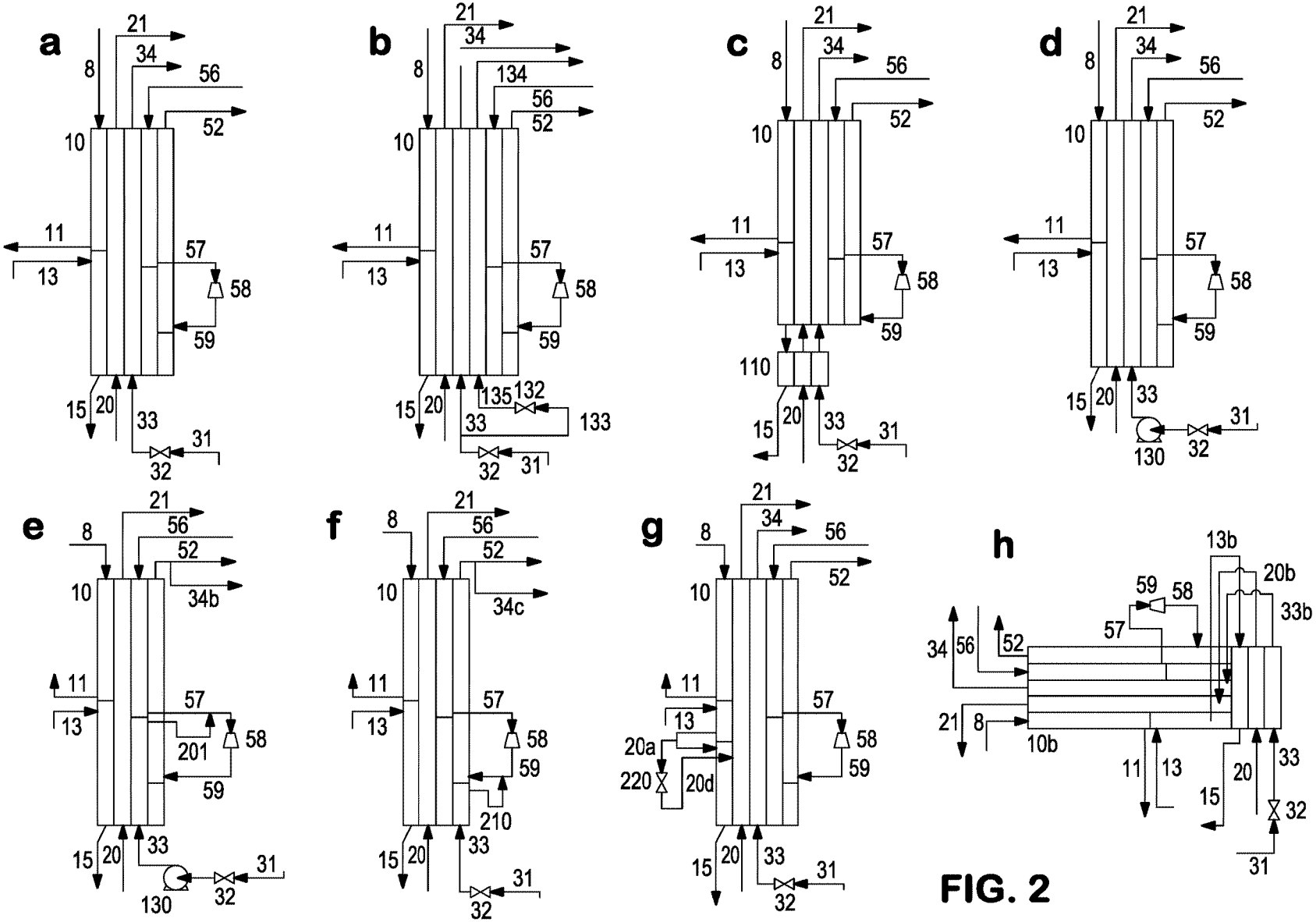

As shown in FIG. 2, several exemplary embodiments are illustrated where the potential PHX and process variants as they apply to the configuration of the main process heat exchanger 10. These exemplary embodiments could be expanded upon and/or combined together with the particular heat exchanger design. FIG. 2(*a*) is the heat exchanger (HX) configuration as shown in FIG. 1. FIG. 2(*b*) depicts dual pressure LIN boiling, for example, in order to reduce exchanger maximum temperature difference in the cold end of the HX, or this configuration could also be advantageous if the $N_2$ recycle compressor suction pressure is above that of the low pressure boiled GAN fluid 34. In this way stream 134 could be used as the makeup source for the recirculating $N_2$ fluid.

FIG. 2(*c*) illustrates the cold end of the PHX split 110, split off from warm end of the heat exchanger 10. This could be advantageous because it could allow a relatively inexpensive, compact and efficient brazed aluminum heat exchanger (BAHX) to be used for the warm multi-stream heat exchange while a separate heat exchanger can be used on the cold end of the process where the temperature differential is higher. The cold end heat exchanger could also be a BAHX or it could be a coil-wound heat exchanger, brazed stainless steel heat exchanger, shell and tube heat exchanger (with 2 or more streams), etc.

In the embodiment of FIG. 2(*d*) pump 130 is utilized to increase the pressure of the LIN boiled in the HX. A LIN pump allows for the LIN storage tank to remain at a low pressure (reduced pressure builder penalty) but can allow for reduced temperature differentials within the PHX 10, or the pump can be used to slightly warm up the temperature of a potentially cold LIN storage tank such that LNG is not frozen at the cold end of the PHX (or a combination of the factors described above).

The embodiment of FIG. 2(*e*) illustrates a related pumped LIN process where LIN is boiled (or pseudo-boiled) and warmed, before it is removed from the PHX as stream 201 which joins the cooled recirculating high pressure $N_2$ flow 57, to be expanded in the turbine 58. In this way extra refrigeration can be extracted from high pressure stream and the PHX can be simplified with less different types of passages. Further, the addition of stream 201 to the recirculating $N_2$ circuit serves as the $N_2$ circuit makeup. Stream 34*b* is the low pressure N2 to be used for pre-purifier regeneration, coldbox purge, etc.

With reference to FIG. 2(*f*) low pressure LIN is boiled in the cold end of the heat exchanger and this stream 210, is then introduced in the turbine discharge 59, before the combined cold GAN is returned to the PHX. This configuration also simplifies the heat exchanger and recirculating GAN makeup. In this embodiment, stream 34*c* is the low pressure $N_2$ to be used for pre-purifier regeneration, coldbox purge, etc.

In the embodiment of FIG. 2(*g*) a portion of the NG feed is being split from the main cooled natural gas stream in the middle of the PHX. This portion of NG is then reduced in pressure and returned to the heat exchanger to be warmed and used for fuel in NG engine drives and/or NG genset and/or in NG fired regen heater. Throttling the NG at a warmer temperature like this serves to take advantage of the large JT effect of isentropically expanding warmer natural gas.

With respect to the embedment of FIG. 2(*h*) a PHX heat exchanger configuration where the multi-stream heat exchanger is generally oriented horizontally for much of the sensible heat exchange with a vertical section to the right where LIN is boiling and LNG is condensing or pseudo condensing is provided. In this embodiment, it could be possible to configure the entire heat exchange process in to one PHX and furthermore the cold-box height can be reduced to reduce field erection costs and enable the employment of equipment that is either portable or more easily re-locatable. In the exemplary embodiment of FIG. 2(*h*) the turbine discharges into the horizontal section but it could discharge either into the horizontal section or in to the vertical section depending on natural gas pressure and location where NG condensation or pseudo-condensation will start. Additionally, it is understood that the LIN boiling section could also be split off into a separate heat exchanger combining the concepts of FIGS. 2(*c*) and (*h*) as the LIN boiling heat exchanger is generally small. The turbine discharge could be routed into the bottom of the vertical section of heat exchanger 10*b* as shown (e.g., in an additional parallel vertical pass where stream 33 is shown entering heat exchanger 10*b*).

Figure 3:
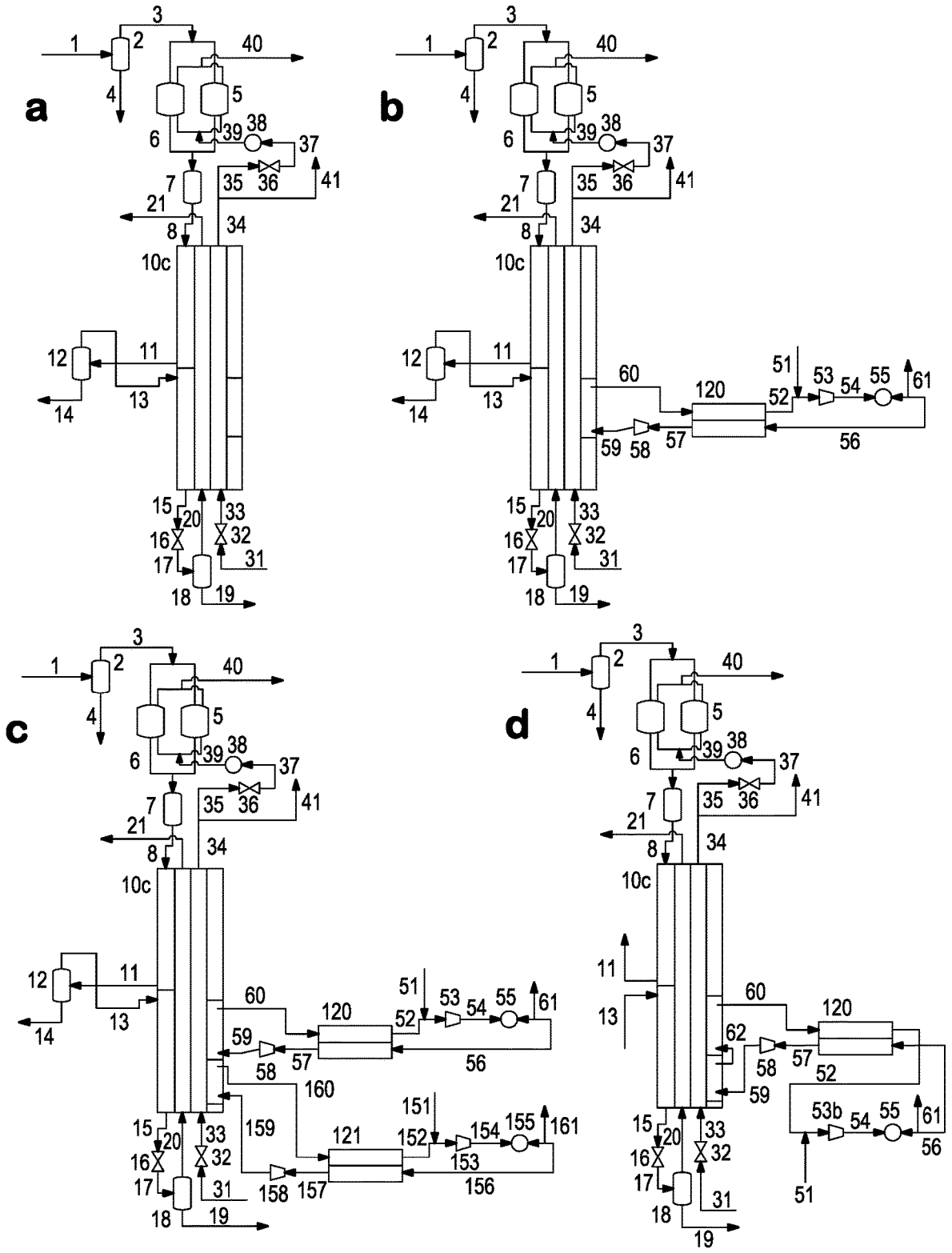
FIG. 3(*b*)*illustrates* Phase 1: LIN only mode (no reverse Brayton refrigeration) for production of relatively low amounts of LNG.

FIG. 3(*b*) shows a configuration which is very similar in performance to the process shown in FIG. 1. However, the PHX 10 as shown in FIG. 1 is split into two sections, namely 10*c* and 120. Splitting the heat exchange in this way results in no or limited process efficiency penalty but allows for some advantages such as potential for deferring capital as the liquefier is upgraded and reducing the size of the heat exchanger 10*c* which has many streams. In heat exchanger 120 high pressure recirculating $N_2$ is cooled before being expanded in the turbine against warming low pressure recirculating $N_2$. The portion of total system duty and UA required to cool and warm recirculating $N_2$ in heat exchanger 120 is about 50-75% of total duty and 75 to 85% of total UA. This heat exchange can be achieved very efficiently and cost-effectively in a 2 stream BAHX (as well as in other types of heat exchanger).

In the embodiment of FIG. 3(*a*) a LIN to LNG process where the main PHX 10*c* is configured to add the reverse Brayton refrigeration at a later time (Phase 1) is provided. In this embodiment, there is relatively little penalty to design heat exchanger 10*c* because heat exchanger 120 has been separated from the main PHX. The initial process operated in FIG. 3(*a*) could then be upgraded to what is shown in FIG. 3(*b*) (Phase 2) which could cut the specific LIN use (LIN required per gallon of LNG produced) by 70% to 80% or more and would also allow the process to produce 3 to 4× the LNG produced by the FIG. 3(*a*) process embodiment. It is understood that along with the upgrade in going from 3*a* to 3*b* as shown in FIG. 3 it is likely that the pre-purification system, LNG storage system and LNG off-loading systems may also need to be upgraded. In addition, splitting the heat exchange liquefaction process as shown in FIG. 3 could be advantageous even if there is no need or desire to ever operate in a LIN only mode as shown in FIG. 3(*b*).

In the embodiments of FIGS. 3(*c*) and 3(*d*) a further upgrade to the system shown in FIG. 3(*b*) is provided where the reverse Brayton refrigeration system is further upgraded to reduce LIN and/or to boost LNG production capacity. The embodiment of FIG. 3(*c*) illustrates a second upgrade (Phase 3) where a second expansion turbine is added and FIG. 3(*d*) illustrates similar second upgrade (alternate Phase 3) where the recycle compressor is upgraded, 53*b*, for a higher pressure ratio which would result in a lower turbine discharge pressure such that the turbine discharge would optimally be fed to a lower location in the main PHX, 10*c*. Along with the upgrades shown in FIG. 3(*c*) and FIG. 3(*d*) other equipment may be included such as inter/aftercooler upgrades, turbine upgrades, valve/control upgrades, pre-purifier upgrades (more beds, different adsorbent, higher regen temperature, etc.) to accommodate the lower available GAN regen flow (or the pre-purification system could be replaced with a system not requiring GAN for regen).

Figure 4:
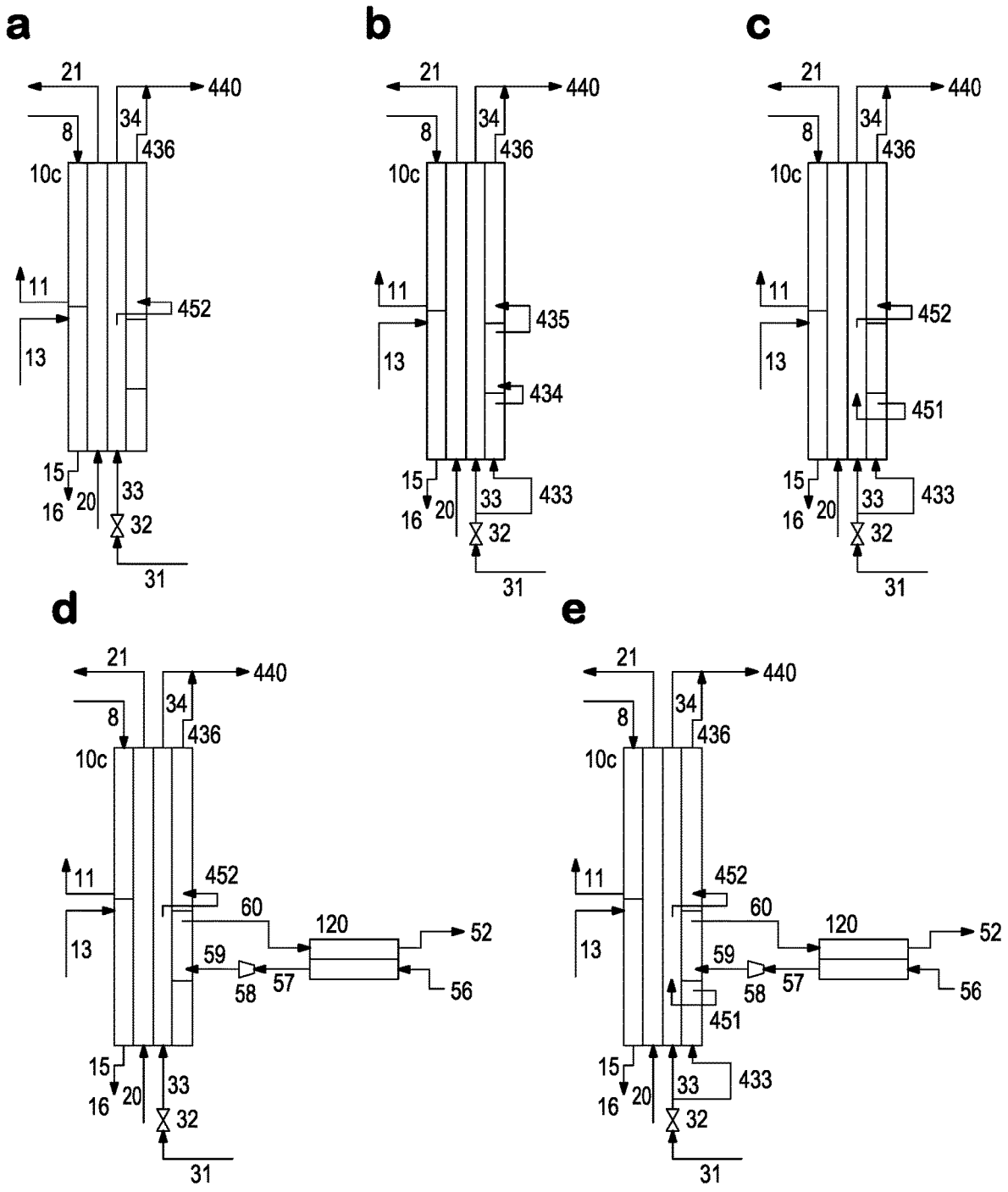
FIG. 4 is a schematic representation of various heat exchanger configurations as they apply to the phased capital investment concept; where.

The embodiments of FIG. 4 shows heat exchanger configurations that apply to Phases 1 (LIN only operation) and Phases 2 (LIN+reverse Brayton operation) as described above. FIGS. 4(*a*), 4(*b*) and 4(*c*) show heat exchanger configurations that allow for enhanced use of the turbine discharge heat exchanger passes in the main heat exchanger 10*c*, when in LIN only mode of operation. The total heat exchanger volume associated with the passes used to warm turbine discharge would be about $\frac{1}{3}^{rd}$ (or more) of the total heat exchanger volume so it is advantageous to utilize this heat exchanger volume if possible to improve cycle efficiency and/or to reduce heat exchanger size. FIG. 4*a* shows a portion of boiled GAN being re-distributed to turbine air layers on the warm end of the PHX, stream 452. FIG. 4(*b*) depicts LIN being boiled and warmed to fully take advantage of the entire turbine pass to fully take advantage of the entire turbine pass via streams 433, 434, 435, 436. When the turbine streams were added in Phase 2 some piping changes would be needed to again free up the turbine passes in the middle of HX 10*c* for warming turbine discharge. FIG. 4(*c*) illustrates an embodiment where LIN is being boiled in the turbine air passes on the cold end of the heat exchanger and GAN being re-distributed and warmed in the turbine air passes on the warm end of the HX. In this embodiment, the turbine air passes in the middle of the heat exchanger are reserved for turbine air to be added at a later dated.

FIG. 4(*d*) depicts Phase 2 configuration corresponding to Phase 1 operation as shown in FIG. 4(*a*). FIG. 4(*e*) illustrates the Phase 2 configuration corresponding to Phase 1 operation as shown in FIG. 4(*c*).

Although various embodiments have been shown and described, the present disclosure is not so limited and will be understood to include all such modifications and variations as would be apparent to one skilled in the art.

The invention claimed is:

1. A natural gas liquefier system, comprising:

a) a natural gas inlet in fluid communication to a source of natural gas;

b) a liquid nitrogen inlet in fluid communication to a source of liquid nitrogen;

c) at least one refrigerant inlet in fluid communication to a source of gaseous refrigerant fluid;

d) at least one gaseous refrigerant outlet at a lower pressure than the refrigerant inlet in fluid communication to a device to receive the lower pressure refrigerant fluid;

e) a liquefier in fluid communication to receive the natural gas, liquid nitrogen, inlet and outlet refrigerant flows which also includes at least one turbine;

f) the at least one turbine which receives a flow of inlet refrigerant and discharges a flow of a reduce temperature refrigerant at a reduced pressure, wherein the inlet flow to the at least one turbine may or may not be pre-cooled within the liquefier module to a sub-ambient temperature; and g) said liquefier receiving the reduced temperature and pressure refrigerant fluid is then warmed where it is processed and discharged from the liquefier as the gaseous refrigerant outlet; and liquefied natural gas output coupled to the liquefier.

2. The method according to claim 1, where the refrigerant outlet fluid exiting the liquefier is compressed externally to the liquefier module and reintroduced to the liquefier as the refrigerant inlet fluid.

3. The method according to claim 1 where electrical or mechanic power is recovered from the at least one turbine.

4. The method according to claim 1 where the gaseous refrigerant fluid is composed on nitrogen.

5. The method according to claim 1 where a flow of vaporized liquid nitrogen leaves the liquefier as warmed gaseous nitrogen.

6. The method according to claim 4 where the warmed gaseous nitrogen is used to regenerate an adsorption based natural gas pre-purification scheme for removal of water and/or carbon-dioxide prior to the natural gas inlet.

7. The method according to claim 1 where the liquefier also includes a separator for removal of heavier hydrocarbons than methane from the natural gas inlet stream before the liquefied outlet natural gas natural leaves the liquefier.

8. The method according to claim 1 where the liquefier also includes the separator and a valve to remove lighter components than methane from a natural gas inlet stream before the liquefied natural gas leaves the liquefier.

* * * * *